US006997340B1

(12) United States Patent
Stefanik et al.

(10) Patent No.: US 6,997,340 B1
(45) Date of Patent: Feb. 14, 2006

(54) ERGONOMIC PACKS FOR PRODUCTION SUPPLY

(75) Inventors: Michael L. Stefanik, Powell, OH (US); Carrie S. Simpson, Columbus, OH (US); John Detwiler, West Liberty, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 115 days.

(21) Appl. No.: 10/419,559

(22) Filed: Apr. 21, 2003

(51) Int. Cl.
*B65D 1/36* (2006.01)

(52) U.S. Cl. ..... 220/507; 414/810; 211/126.15; 206/561

(58) Field of Classification Search ..... 220/507–508; 414/810, 801, 808; 211/126.15, 128.1; 206/740, 206/743–745, 501, 585, 561; 217/9–11, 217/40, 18, 28
See application file for complete search history.

(56) References Cited

U.S. PATENT DOCUMENTS 751,466 A * 2/1904 Colling ..... 211/162
2,247,341 A * 6/1941 Anderson ..... 229/120.37
3,325,001 A * 6/1967 Rawlings ..... 206/362
4,171,742 A 10/1979 Kohayakawa et al.
4,444,535 A 4/1984 VanMersbergen
4,588,341 A * 5/1986 Motoda ..... 414/788.4
4,619,365 A 10/1986 Kelly et al.
4,648,524 A * 3/1987 Ackermann ..... 220/507
4,705,170 A 11/1987 Creaden
4,799,620 A 1/1989 Velella
4,905,834 A 3/1990 Mur Gimeno et al.
4,913,339 A 4/1990 Elder
4,919,277 A 4/1990 Jeruzal
4,925,038 A * 5/1990 Gajewski ..... 211/59.2
5,277,359 A 1/1994 Lindsay
5,419,009 A 5/1995 Assis et al.
5,505,309 A 4/1996 Taravella et al.
5,887,782 A 3/1999 Mueller
5,921,739 A * 7/1999 Keip ..... 414/331.14
6,007,030 A 12/1999 Judge
6,029,582 A 2/2000 Ogilvie, Jr. et al.
6,343,708 B1 * 2/2002 Riso ..... 220/23.88
2004/0007492 A1 * 1/2004 Winkler ..... 206/518

* cited by examiner

*Primary Examiner*—Jes F. Pascua
(74) *Attorney, Agent, or Firm*—Standley Law Group LLP

(57) ABSTRACT

An apparatus is disclosed for providing easier, more ergonomic access to parts stored in a shipping container to be used in a manufacturing environment. Shipping containers having trays with packaging cells for containing production parts may be accessed by a person whose responsibility it is to remove the parts from the container for use on an assembly line, for example. By enabling the trays containing packaging cells to be moved forward as parts are removed from the container, the person's job is rendered easier to access parts that would have otherwise remained at the rear of the container. In a preferred embodiment, the packaging cells or packs are arranged to slidably move closer to the person removing the parts.

19 Claims, 3 Drawing Sheets

ERGONOMIC PACKS FOR PRODUCTION SUPPLY

FIELD OF THE INVENTION

The present invention relates to an apparatus for delivering parts to an assembly line or other production area in a manufacturing environment. In particular, the present invention relates to containers and packaging cells within the containers that are designed to achieve improved ergonomics in the availability of parts for use in a manufacturing process.

BACKGROUND AND SUMMARY OF THE INVENTION

It is known to deliver parts for use in a production line to the line in containers of various types. The known containers are physically divided into layers of packaging cells, each cell for holding a part, to thereby segregate the parts from one another for ease of handling during removal from the cells and for avoidance of damage to the parts that could otherwise result from parts colliding together during movement of the shipping container. Once delivered to the production line, a person working at the production line removes individual parts from the container so that the parts may be used in the production process. For example, parts to build portions of an automobile in an automobile production line environment may arrive at the production line in a shipping container, which is placed near the production line to allow a person access to remove a part from the container for use in the production process. Some of these parts may be bulky in size, relatively heavy, and/or awkward to handle.

It is typically not economical or efficient to individually ship parts for a production process, therefore, several parts are shipped in a single container. Typically, a container may be subdivided into multiple, stacked layers with each layer having several packaging cells or "packs" wherein each pack or cell preferably contains one part to be used in the manufacturing process. The packs aid in at least two ways. First, the packs separate one part from another for ease of handling purposes. Second, the packs separate the parts from one another so that they do not become entangled with each other or collide with other parts during movement of the shipping container from one location to another.

Such known shipping containers may be several feet wide, several feet deep and several feet long, and are typically designed to fit on a standard 48 inch by 45-inch pallet base. The shipping containers may contain multiple layers stacked on top of one another with each layer having a plurality of packaging cells or packs. Once the shipping container is brought to the manufacturing environment to be used, for example, in providing parts for a production line, the container may be placed in a position next to or near the line and the person working at that area begins to remove parts from the packs in the shipping container. Due to the nature of the size of the shipping container and the number of parts in it there will be parts that exist in packs relatively closer to the person responsible for handling the parts and there will be other parts further removed, in packs at the rear of the shipping container, that will necessitate a longer reach by the person removing the parts. Therefore, certain parts contained in packs at the rear of the shipping container will be more difficult to reach and lift out of the packs in the rear of the container.

The present invention is an improved shipping container comprising multiple trays per layer within the container, each tray having packs thereon, designed with ergonomics in mind. Therefore, the present invention is relatively easier for a person handling the parts to use. The ergonomic packs of the present invention may be arranged on or form a part of a tray. As a forward resting tray within a layer of the container is emptied of parts from each pack, that tray may be removed from the container and a rearward resting tray may be grasped by its handle and the tray pulled forward in the container so that the parts in the packs of that tray may now be more easily retrieved from each pack. Each tray may be supplied with a handle for enabling a person to slide trays having packs thereon closer to the person. Parts that may be in packs at the rear of the container are thus able to be moved forward or closer to the person prior to removing those parts from the rear-most packs. By enabling the person handling the parts to lesson the moment arm (resulting from the length of the reach a person has to make to grasp a part in a rearward pack multiplied by the weight of the part) the person handling the parts requires less force and thereby the parts removal process is rendered easier.

The trays are preferably adapted to slide with respect to a surface beneath them using a differential height design for the walls of the packs. In addition to the differential wall height of the packs, the assembly of the packs is done in a manner that allows for a smooth bottom surface under the trays to enable the trays to freely slide with respect to the surface beneath them (which may be another layer or tray of additional packs in a stacked configuration within the container).

DESCRIPTION OF EXAMPLE EMBODIMENTS

Figure 1:
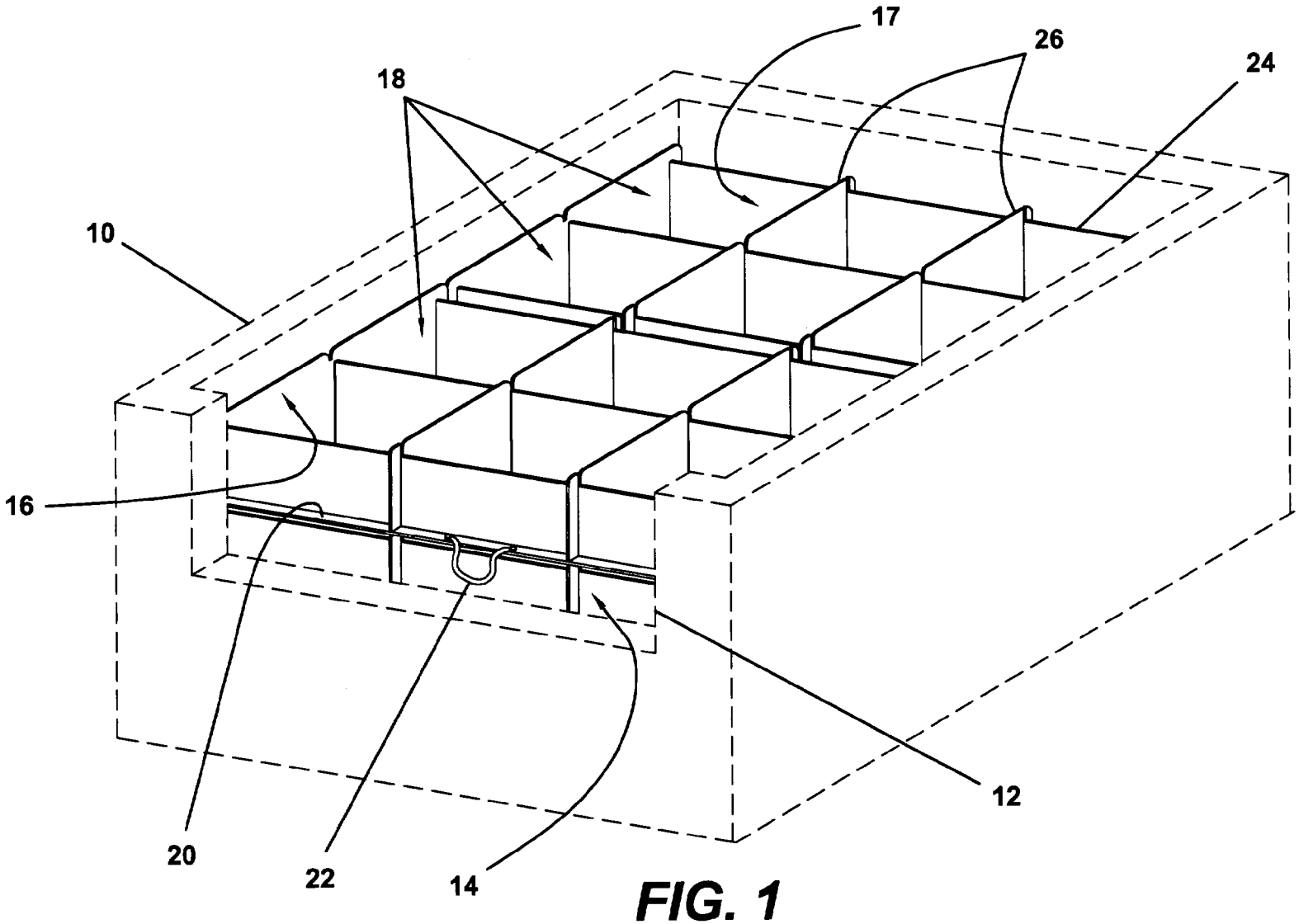
FIG. 1 is a perspective view of the ergonomic packs formed on trays of the present invention as shown in a shipping container.

Referring now to the drawings, and particularly FIG. 1, there is shown (in phantom) a parts shipping container 10, sometimes referred to as a drop shipment container or "drop shipper". Depending upon the height of the shipping container, the shipping container may or may not have a door or access panel that opens to create access to parts inside the shipping container through an opening 12. In the preferred embodiment of the invention as shown in FIG. 1, a plurality of stacked shipping trays 14, 15, 16, 17 are contained within the container 10. Within each tray 14, 15, 16, 17 there are a plurality of packaging cells or packs 18. Each pack 18 is of a sufficient length, width and depth to house a part to be used in a manufacturing process. The packs 18 may be formed with walls 24, 26 secured to a lower surface 20 of the tray.

Figure 3:
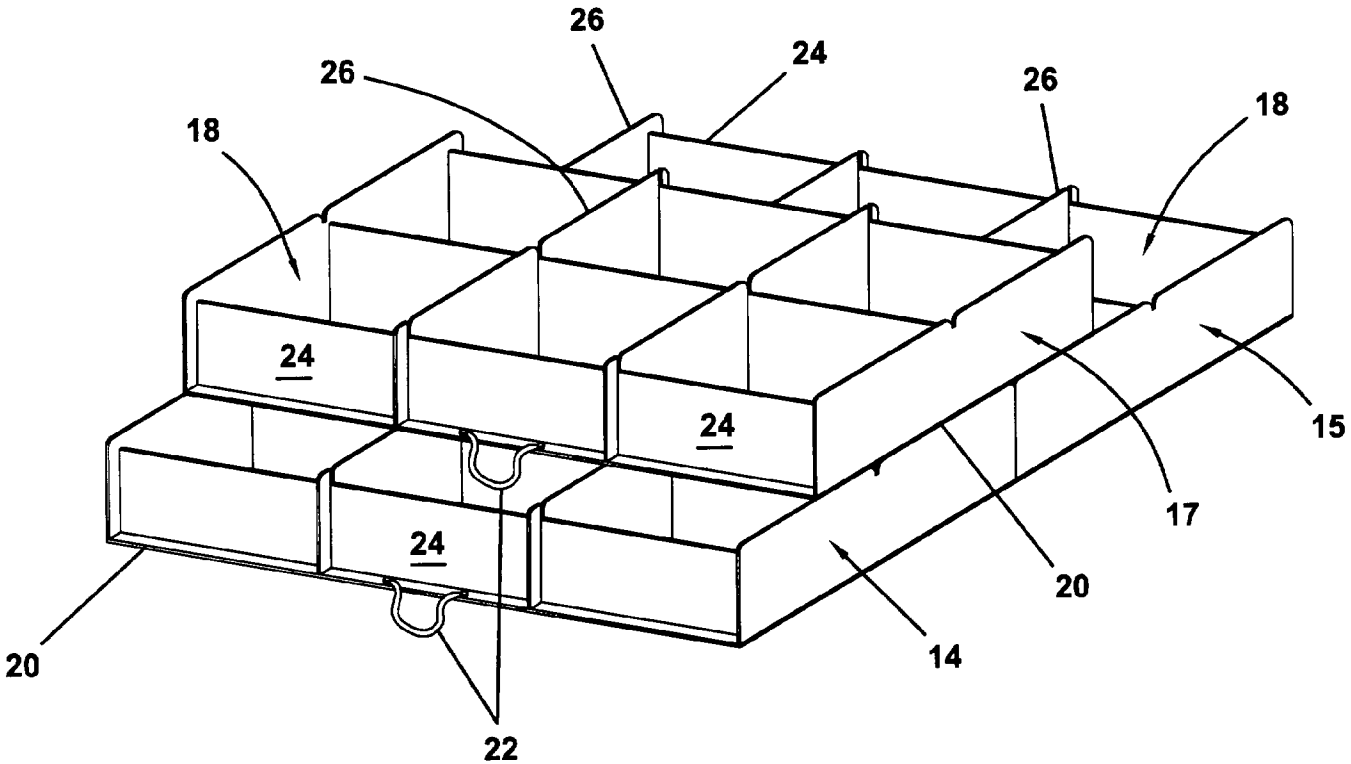
FIG. 3 is a perspective view showing three trays of packs in a stacked configuration with the upper layer tray shown in a position where it has been slid forward with respect to the lower layer trays.

Each pack 18 need not be the same size and shape as other packs on a tray. A variety of different sizes and shapes for the packs 18 may be incorporated to efficiently accommodate different sizes and shapes of parts to be used in a manufacturing process. Typically, a person removing parts from the container 10 would stand at or near the front of the container 10 and reach for the parts contained in the packs 18 nearest the front. Upon emptying the parts from the packs 18 nearest the front, the person removing the parts would have reached back to the packs 18 at the rear of the shipping container 10 to access the parts held in those packs. To make it easier for the person removing the parts, the packs 18 on the trays at the back of the container of the present invention are adapted to be moved closer to the person removing the parts. For example, as shown in FIG. 3, tray 16 (then empty) has been removed from the container and with a handle 22 that may be secured to a portion of tray 17 the person removing the parts may grasp the handle 22 and pull the tray 17 forward, closer to the front, to gain easier access to the parts held in the packs 18 in tray 17.

In order to enable upper layer trays 16 and 17 to move relative to the lower trays 14, 15, certain design features are preferably implemented to enable the sliding of upper layer trays over lower layer trays. In a preferred embodiment, the walls 24, 26 of each pack 18 are given a differential height to enable an upper layer tray to slide longitudinally toward the front over the top of tray 14 for example. As shown in FIG. 3, the longitudinal walls 26 (i.e., walls running the same direction as the direction of slide) are of an increased height relative to the lateral walls 24 (i.e., walls running perpendicular to the direction of slide). Such a construction of the walls of the packs on the trays enable the bottom surface 20 of each tray to slide unimpeded along the upper rim surfaces of the longitudinal walls 26 of lower trays. The longitudinal walls 26 may include rounded edges 27 to further facilitate sliding of the relative trays. Furthermore, the trays are preferably assembled in such a manner that the lower surface 20 has a smooth sliding surface in contact with lower trays. For example, the walls 24, 26 of the packs on tray 16 may be secured to an up side of bottom 20 using sonic welds that are done internally of each pack 18 so as to not impede the down side sliding surface of bottom 20.

Figure 2B:
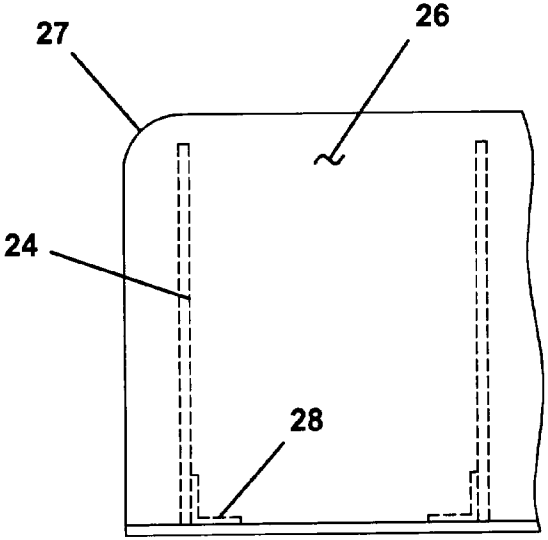
FIG. 2B is a partial side view of the tray of FIG. 2A.
Figure 2C:
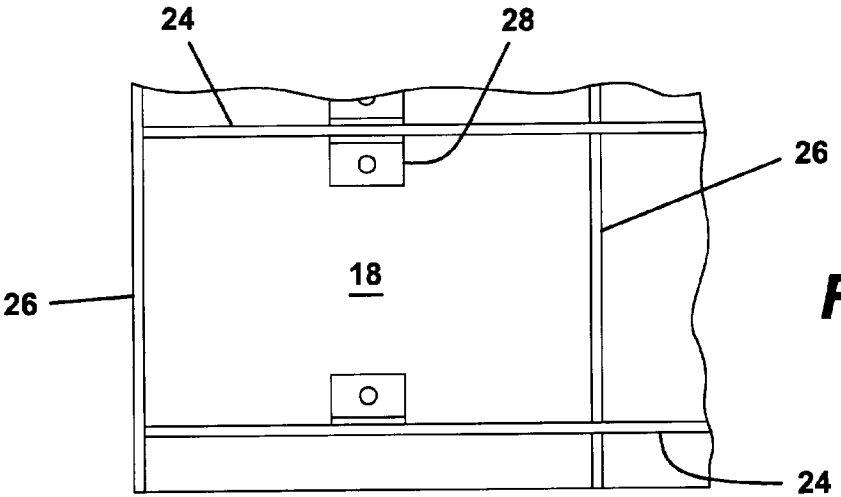
FIG. 2C is a partial plan view of the open end of the tray shown in FIG. 2A.
Figure 2A:
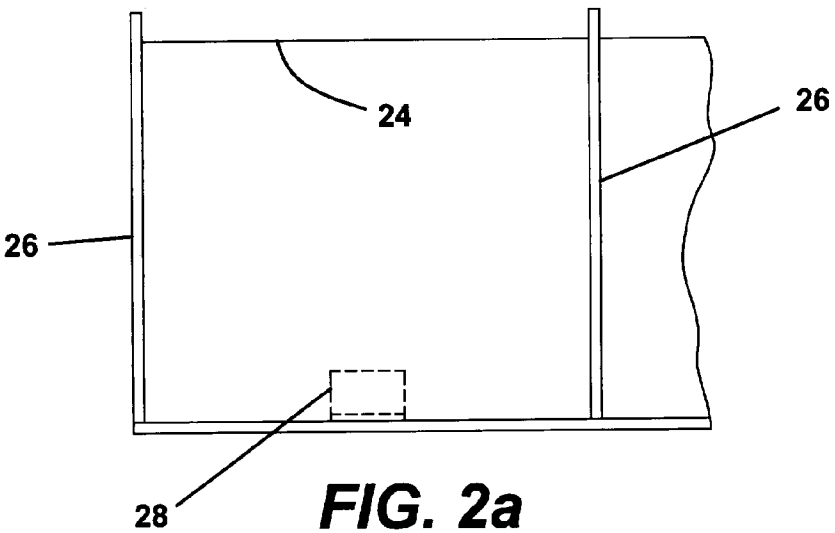
FIG. 2A is a partial end elevation view of a tray of the present invention.

This can be better seen in FIGS. 2A, 2B and 2C. The sonic welds 28 are performed inside the packs 18 rather than on the down-side surface of bottom 20 that slides on the upper rim surfaces of trays 14, 15. Once tray 17 is slid forward in the container 10 and the person handling the parts successfully removes the parts in the rear-most packs 18, the entire tray 17 may be physically removed from the container 10 enabling access to the parts contained on trays 14, 15. The same process is then repeated whereby parts in the forward most packs 18 of tray 14 are removed first, tray 14 is then lifted out of the container 10, the rearward tray 15 is pulled forward and the parts in the packs 18 of the rearward tray 15 are then retrieved. By providing the trays with means to move forward, closer to the front, the person handling the parts exerts a lower moment arm with respect to the force needed to remove a part from a rearward pack.

The present invention thus reduces the level of exertion necessary to remove parts from shipping containers in a manufacturing environment by enabling a person removing parts from such a container to pull or slide trays with packs containing parts forward in the shipping container thereby reducing the moment arm for removing parts in the rearward most tray packs. As a result, production line efficiency is improved which may result in reduced production costs.

The present invention solves ergonomic reach and weight constraints affiliated with shipment of parts of substantial weight and quantity to production lines. Parts packed in quantities may be manually handled with less effort by minimizing pack weight and drag force. By reducing the latitudinal or cross member cell wall heights relative to the longitudinal length member cell wall heights, sliding of the packaging cell trays is enabled without interference from the walls of the packs. Furthermore, the unimpeded, internal sonic welded flat sheets holding the walls of the packs to the bottom of the trays eliminates the need for external securing devices such as welds, nuts, bolts, etc. from impeding the sliding action.

Shipping containers 10 are available from numerous sources around the world and are well known to those of skill in the art. The individual packaging cell trays may be purchased from Polycell Incorporated in Columbus, Ohio.

INDUSTRIAL APPLICABILITY

The present invention improves the delivery of parts to a production line of a manufacturing facility by improving the accessibility of parts stored in packaging cells at or near the rear of shipping containers. By enabling the parts stored at the rear of the shipping containers to be more readily accessible to the person removing the parts from the shipping container, the removal of parts for production line purposes is rendered easier for the person having that responsibility.

While example embodiments of the invention have been illustrated and described, various modifications and combinations can be made without departing from the spirit and scope of the invention. For example, the trays and packs may be made of various materials, shapes, and sizes. Furthermore, the packaging trays may be constructed to move in a manner other than a simple sliding motion over a lower surface. Modifications, combinations, and equivalents to the apparatus of the present invention are intended to be covered and claimed herein.

What is claimed is:

1. A process for providing parts to be used in a manufacturing environment, said process comprising:
   - providing a container holding a plurality of stacked trays arranged in multiple layers inside said container, each tray adapted to slide directly over top of a subjacent tray, each tray having packaging cells thereon, each packaging cell being capable of containing at least one part therein;
   - providing a parts removal entryway through at least one wall of said container;
   - removing parts from packaging cells in a first tray at an upper layer and transporting said parts through said parts removal entryway of said container;
   - removing said first tray from said container when said first tray is empty of said parts;
   - pulling a second tray, initially at a rearward position in said upper layer of said container, forward and directly over subjacent trays to a point closer to said parts removal entryway, thereby enabling closer access to packaging cells in said second tray of said container.

2. The process of claim 1, wherein said second tray is comprised of packaging cells having walls assembled using a fastening technique that enables a bottom surface of said second tray to be unimpeded while sliding over a lower layer of said container.

3. The process of claim 1, wherein said walls of said packaging cells of said second tray are assembled to a bottom of said second tray using sonic welds accomplished internal of said packaging cells.

4. The process of claim 1, wherein said second tray packaging cell walls are assembled such that longitudinal walls, running in the direction of slide, are made higher than lateral walls, running perpendicular to the direction of slide of said second tray in said container.

5. The process of claim 1, wherein said packaging cell walls are made of corrugated plastic material.

6. The process of claim 1, wherein said pulling step is accomplished by said second tray being adapted with a handle.

7. The process of claim 1, wherein removing parts from said second tray pulled forward in said container produces a lower moment than would have been required with said tray in said rearward position in said container.

8. An ergonomically improved process for providing parts to be used in a manufacturing operation, said process comprising:

providing a container holding a plurality of stacked trays arranged in multiple layers inside the container, each layer having a forward tray near a parts removal entryway of said container and a rearward tray, each tray having packaging cells thereon capable of containing at least one part;

removing parts from packaging cells in said forward tray of an uppermost layer present in said container;

removing said forward tray from said container when said first tray is empty of said parts;

pulling said rearward tray forward and directly over subjacent trays to a point closer to said parts removal entryway, thereby enabling easier access to said packaging cells therein.

9. The process of claim 8, wherein said rearward tray is comprised of packaging cells having walls assembled using a fastening technique that enables a bottom surface of said rearward tray to move unimpeded while sliding over a lower layer of said container.

10. The process of claim 8, wherein said rearward tray packaging cell walls are assembled such that longitudinal walls, running in the direction of slide, are made higher than lateral walls, running perpendicular to the direction of slide of said rearward tray in said container.

11. The process of claim 8, wherein said packaging cell walls are made of corrugated plastic material.

12. The process of claim 8, wherein said pulling step is accomplished by using a handle located on said rearward tray.

13. The process of claim 8, wherein removing parts from rearward tray pulled forward in said container requires less effort than would have been required with said tray in its normal rearward position in said container.

14. An ergonomically improved process for providing parts to be used in a manufacturing operation, said process comprising:

(a) providing a container holding a plurality of stacked trays arranged in multiple layers inside said container, each layer having a forward tray near a parts removal entryway of said container and a rearward tray disposed behind said forward tray, each tray having packaging cells thereon capable of containing at least one part;

(b) removing parts from packaging cells in a forward tray of an uppermost layer currently present in said container;

(c) removing said forward tray from said container when said first tray is empty of said parts;

(d) pulling a corresponding rearward tray of said uppermost layer currently present in said container forward and directly over subjacent trays to a point closer to said parts removal entryway, thereby enabling easier access to said packaging cells therein;

(e) removing said rearward tray of said uppermost layer when said tray is empty of said parts;

(f) repeating steps (b)–(e) for each subsequent layer of parts containing trays present in said container above a bottom layer; and (g) repeating steps (b)–(d) or (b)–(e) for said bottom layer of trays containing said parts.

15. The process of claim 14, wherein said rearward tray is comprised of packaging cells having walls assembled using a fastening technique that enables a bottom surface of said rearward tray to move unimpeded while sliding over a lower layer of said container.

16. The process of claim 14, wherein said rearward tray packaging cell walls are assembled such that longitudinal walls, running in the direction of slide, are made higher than lateral walls, running perpendicular to the direction of slide of said rearward tray in said container.

17. The process of claim 14, wherein said packaging cell walls are made of corrugated plastic material.

18. The process of claim 14, wherein said pulling step is accomplished by using a handle located on said rearward tray.

19. The process of claim 14, wherein removing parts from rearward tray pulled forward in said container requires less effort than would have been required with said tray in its normal rearward position in said container.

* * * * *